US007518311B2

(12) United States Patent
Hong et al.

(10) Patent No.: US 7,518,311 B2
(45) Date of Patent: Apr. 14, 2009

(54) PLASMA DISPLAY PANEL AND MANUFACTURING METHOD THEREOF

(75) Inventors: Chong-Gi Hong, Suwon-si (KR); Tae-Kyoung Kang, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 504 days.

(21) Appl. No.: 11/181,137

(22) Filed: Jul. 13, 2005

(65) Prior Publication Data

US 2006/0061277 A1 Mar. 23, 2006

(30) Foreign Application Priority Data

Sep. 21, 2004 (KR) ..... 10-2004-0075410

(51) Int. Cl.
*H01J 17/49* (2006.01)

(52) U.S. Cl. ..... 313/586; 313/582

(58) Field of Classification Search ..... 313/582, 313/586

See application file for complete search history.

(56) References Cited

U.S. PATENT DOCUMENTS

| | | | | |
|---|---|---|---|---|
| 5,977,708 | A * | 11/1999 | Amatsu et al. | 313/586 |
| 7,019,461 | B2 * | 3/2006 | Harada | 313/586 |
| 7,253,560 | B2 * | 8/2007 | Harada | 313/586 |
| 2002/0003406 | A1 * | 1/2002 | Kang et al. | 313/587 |
| 2003/0197469 | A1 * | 10/2003 | Kang et al. | 313/586 |
| 2003/0209983 | A1 * | 11/2003 | Harada | 313/586 |
| 2004/0245928 | A1 * | 12/2004 | Fujitani | 313/584 |

FOREIGN PATENT DOCUMENTS

| | | |
|---|---|---|
| JP | 11-040064 | 2/1999 |
| JP | 11-154461 | 6/1999 |
| JP | 2002-050289 | 2/2002 |
| JP | 2003-162964 | 6/2003 |
| JP | 2003-217444 | 7/2003 |
| JP | 2004-58329 | 2/2004 |
| JP | 2004-95536 | 3/2004 |

(Continued)

OTHER PUBLICATIONS

Patent Abstracts of Japan, Publication No. 11-154461, dated Jun. 8, 1999, in the name of Yasushi Tantani.

(Continued)

*Primary Examiner*—Peter Macchiarolo
(74) *Attorney, Agent, or Firm*—Christie, Parker & Hale, LLP

(57) ABSTRACT

An exemplary plasma display panel according to one embodiment includes a first substrate and a second substrate, a barrier rib, address electrodes, a phosphor layer, display electrodes, and a first dielectric layer. The first and second substrates are disposed facing each other. The barrier rib is disposed between the first and second substrates and forms discharge cells. The address electrode is formed in one direction on the first substrate corresponding to the discharge cells. The phosphor layer is formed in each discharge cell. A display electrode is formed in a direction that crosses the address electrode on the second substrate. A first dielectric layer covers the address electrode. The first dielectric layer is formed, in the direction of the length of the address electrode, up to at least one of the edges of the first substrate.

8 Claims, 8 Drawing Sheets

FOREIGN PATENT DOCUMENTS

| | | |
|---|---|---|
| JP | 2006-512723 | 4/2006 |
| KR | 1999-0054279 | 7/1999 |

OTHER PUBLICATIONS

Patent Abstracts of Japan, Publication No. 2003-217444, dated Jul. 31, 2003, in the name of Masashi Amatsu et al.

Patent Abstracts of Japan, Publication No. 2004-058329, dated Feb. 26, 2004, in the name of Nobuyuki Kirihara.

English translation of abstract of Korean Patent Laid-Open Publication 1999-0054279, dated Jul. 15, 1999.

Patent abstracts of Japan for publication No. 2004-095536 dated Mar. 25, 2004 in the name of Morio Fujitani.

* cited by examiner

PLASMA DISPLAY PANEL AND MANUFACTURING METHOD THEREOF

CROSS-REFERENCE TO RELATED APPLICATIONS

This application claims priority to and the benefit of Korean Patent Application No. 10-2004-0075410 filed in the Korean Intellectual Property Office on Sep. 21, 2004, the entire content of which is incorporated herein by reference.

BACKGROUND OF THE INVENTION (a) Field of the Invention

The present invention relates to a technology for fabricating a plurality of substrates using one mother glass, and more particularly, to a technology for uniformly applying a dielectric layer on each of a plurality of substrates fabricated from one mother glass.

(b) Description of the Related Art

A plasma display panel (PDP) is a device for displaying images using a gas discharge phenomenon. PDP has excellent benefits in multiple display characteristics, such as brightness, contrast, after-image, and viewing angle, over other display device types. A PDP is formed by combining a front plate and a rear plate together. The front plate is created by forming a display electrode and a dielectric layer on a front substrate. The rear plate is created by forming an address electrode, a dielectric layer, barrier ribs partitioning discharge cells, and a phosphor layer on a rear substrate.

A pair of display electrodes are formed on the front substrate corresponding to each discharge cell. The display electrodes are covered with the dielectric layer that protects the display electrodes and induces charged particles. Similarly, an address electrode is formed on the rear substrate corresponding to each discharge cell. The address electrode is covered with the dielectric layer, thereby protecting the address electrode.

Such dielectric layers covering the display electrodes and the address electrode are formed through various methods such as a printing method, dry film method, or coating method, after forming the display electrodes and the address electrode respectively on the front substrate and the rear substrate. The printing method forms the dielectric layer using a printing device. The dry film method forms the dielectric layer by laminating a dry film resistor (DFR) and then baking it. The coating method forms the dielectric layer by directly spraying a dielectric material onto the electrodes using a coating device.

The coating method forms the dielectric layer by spraying dielectric material paste using a coating device, as a result, the thickness of the dielectric layer may be relatively thin, during an early stage of injection, because an amount of the sprayed dielectric material paste may be relatively small during that period due to the viscosity of the paste and the friction between the paste and an inner surface of a nozzle of the coating device. On the other hand, a thickness of the dielectric layer may be relatively thick, at a region where the injection ceases, because an amount of the sprayed dielectric material paste may be relatively great in that region. Consequently, it is difficult to form a dielectric layer having a uniform thickness on the substrate. Furthermore, such a problem becomes much more serious when a plurality of substrates are fabricated using one mother glass.

In the case where a dielectric layer is formed on one mother glass that will be divided into a plurality of substrates, the dielectric layers are formed by intermittently spraying dielectric material paste for respective substrates. That is, because spraying of dielectric material paste is stopped at a region between neighboring substrates, it is difficult to form a dielectric layer with a uniform thickness over the whole substrate.

SUMMARY OF THE INVENTION

The embodiments of the present invention provide a manufacturing method for a plasma display panel having the features of forming at least one substrate having a uniform thickness from one mother glass and a plasma display panel manufactured by this method.

An exemplary plasma display panel according to one embodiment of the present invention includes a first substrate and a second substrate, a barrier rib, address electrodes, a phosphor layer, display electrodes, and a first dielectric layer. The first and second substrates are disposed facing each other. The barrier rib is disposed between the first and second substrates and forms discharge cells. The address electrodes are formed running in one direction on the first substrate corresponding to the discharge cells. The phosphor layer is formed in each discharge cell. Display electrodes are formed running in a second direction on the second substrate crossing the address electrodes. A first dielectric layer covers the address electrodes. The first dielectric layer is formed, in the direction of the length of the address electrodes, continuing up to at least one of the edges of the first substrate.

The first substrate may include a display area and a non-display area surrounding the display area. The first dielectric layer may be formed starting from the non-display area positioned near one edge of the first substrate continuing up to an opposite edge of the first substrate.

The first dielectric layer may be formed with a first thickness in a first portion of the first dielectric layer on the non-display area positioned near the one edge of the first substrate and with a second thickness, which is different from the first thickness, in the remaining portion of the first dielectric layer.

The second thickness may be greater than the first thickness, and the second thickness may be uniform over the whole of the remaining portion.

In a further embodiment, the plasma display panel may further include a second dielectric layer covering the display electrodes. The second dielectric layer may be formed, in the direction of the length of the address electrodes, continuing up to at least one of the edges of the second substrate.

The second substrate may include a display area and a non-display area surrounding the display area. The second dielectric layer may be formed starting from the non-display area, which is positioned near one edge of the second substrate, continuing up to an opposite edge of the second substrate.

The second dielectric layer may be formed with a first thickness in a first portion of the second dielectric layer on the non-display area positioned near the one edge and with a second thickness, which is different from the first thickness, in the remaining portion of the second dielectric layer.

The second thickness may be greater than the first thickness, and the second thickness may be uniform over the whole remaining portion of the second dielectric layer.

An exemplary manufacturing method for a plasma display panel according to one embodiment of the present invention includes fabricating a first plate by forming address electrodes and a first dielectric layer covering the address electrodes on a first substrate, fabricating a second plate by forming display electrodes and a second dielectric layer covering the display electrodes on a second substrate, combining the first and second plates together, evacuating a space between the first and second plates, and injecting a discharge gas into a discharge space between the first and second plates. In fabricating the first plate, the first dielectric layer is formed, in the direction of the length of the address electrodes, up to at least one of the edges of the first substrate.

A manufacturing method for a plasma display panel according to another embodiment of the present invention includes fabricating a plurality of first plates respectively provided with address electrodes and a first dielectric layer covering the address electrodes from a first mother glass, fabricating a plurality of second plates respectively provided with display electrodes and a second dielectric layer covering the display electrodes from a second mother glass, combining the first and second plates together, evacuating a space between the first and second plates, and injecting a discharge gas into a discharge space between the first and second plates.

Fabricating the first plate includes forming the first dielectric layer on the address electrodes formed on the first mother glass, and cutting the first mother glass into respective first plates in a direction crossing the length of the address electrodes.

A dielectric material paste may be continuously applied in a direction of the length of the address electrodes.

Each of the first plates may include a display area and a non-display area surrounding the display area. In the forming of the first dielectric layer, the first dielectric layer may be sprayed onto the first plate starting from the non-display area, which is positioned near one edge of the first plate, continuing up to an opposite edge of the first plate.

The first dielectric layer may be formed with a first thickness in a first portion of the first dielectric layer on the non-display area, which is positioned near one edge of the first plate, and with a second thickness, which is different from the first thickness, in the remaining portion of the first dielectric layer.

The second thickness may be greater than the first thickness, and the second thickness may be uniform over the whole remaining portion.

Each of the second plates may include a display area and a non-display area surrounding the display area. In the fabricating of the second plate, the second dielectric layer may be sprayed on the second plate starting from the non-display area, which is positioned near one edge of the second plate, continuing up to an opposite edge of the second plate.

The second dielectric layer may be formed having a first thickness in a first portion of the second dielectric layer on the non-display area, which is positioned near one edge of the second plate, and with a second thickness, which is different from the first thickness, in the remaining portion of the second dielectric layer.

BRIEF DESCRIPTION OF THE DRAWINGS

Embodiments of the present invention will hereinafter be described in detail with reference to the accompanying drawings, wherein like reference characters indicate like reference elements in each view.

DETAILED DESCRIPTION

Figure 1:
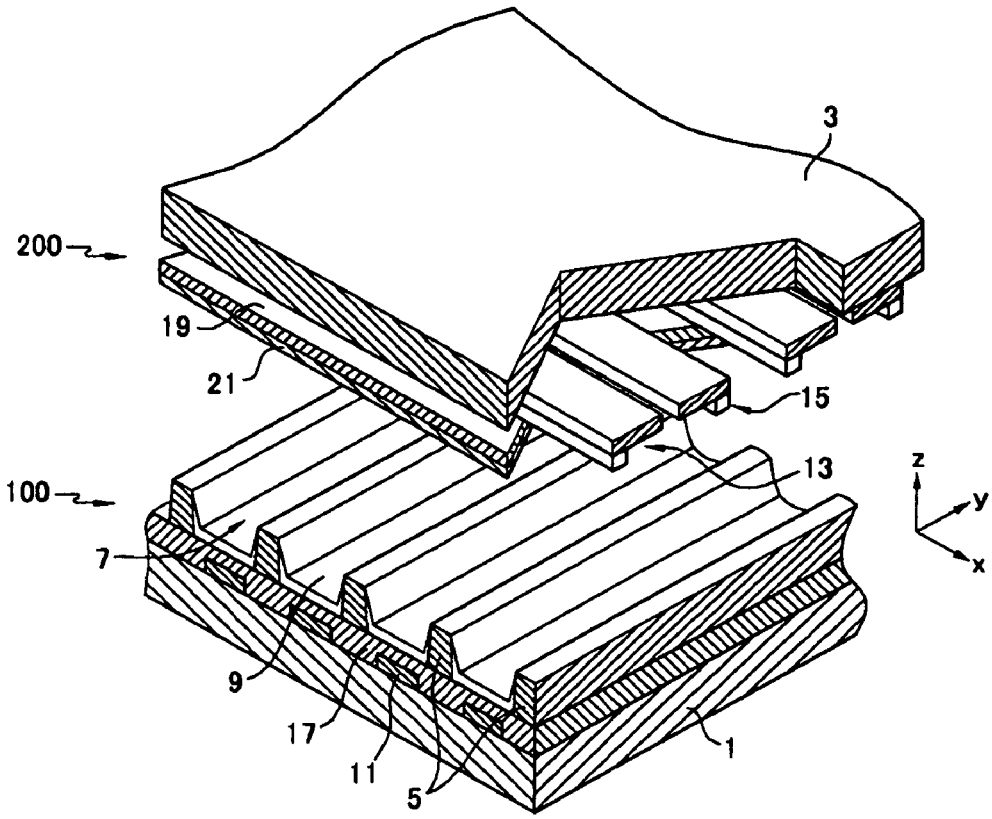
FIG. 1 is a partially exploded perspective view of a plasma display panel according to an embodiment of the present invention.

FIG. 1 is a partially exploded perspective view of a plasma display panel according to an embodiment of the present invention.

Referring to FIG. 1, a plasma display panel (PDP) according to one embodiment is formed by combining a first plate (hereinafter, called a rear plate) 100 and a second plate (hereinafter, called a front plate) 200 together to face each other, where the first plate 100 includes a first substrate (hereinafter, called a rear substrate) 1 and the second plate 200 includes a second substrate (hereinafter, called a front substrate) 3. Barrier ribs 5 formed between the rear substrate 1 and the front substrate 3 define a plurality of discharge cells 7 in which a plasma discharge is generated. A phosphor layer 9 is formed on an inner surface of the barrier ribs 5 that form the discharge cells 7. The discharge cells 7 are filled with a discharge gas (for example, Ne—Xe compound gas). The PDP forms plasma by discharging the discharge gas in the discharge cells 7. The PDP creates images by exciting the phosphor layer 9 of red, green, and blue colors using vacuum ultraviolet (VUV) generated during the discharge.

In order to generate plasma discharge in the discharge cells 7 as mentioned above, the rear plate 100 includes address electrodes 11 formed on the rear substrate 1 corresponding to the discharge cells 7, and the front plate 200 includes display electrodes 13 and 15 formed on the front substrate 3 corresponding to the discharge cells 7.

The address electrodes 11 are formed running in one direction (i.e., the y-axis direction in the drawing) on the rear substrate 1. The address electrodes 11 are disposed in parallel across the x-axis in the drawing each disposed below a gap in the barrier ribs 5 corresponding to the discharge cells 7. The display electrodes 13 and 15 are laid out in a second direction (i.e., the x-axis direction in the drawing) crossing the address electrodes 11. The display electrodes 13 and 15 are laid out in parallel and are disposed across the y-axis, crossing the gap corresponding to the discharge cells 7. A pair of display electrodes 13 and 15 is disposed across each discharge cell 7.

The address electrodes 11 are covered with a first dielectric layer 17 for accumulating a wall charge and protecting the address electrodes 11. The display electrodes 13 and 15 are both covered with a second dielectric layer 19 and a protective layer 21.

Barrier ribs 5 are formed on the first dielectric layer 17. The phosphor layer 9 is formed on an inner surface of the barrier ribs 5 and on a portion of the surface of the first dielectric layer 17 within the discharge cells 7.

The first dielectric layer 17 and the second dielectric layer 19 may be formed through various methods. In one embodiment, they are formed with a uniform thickness in order to obtain a uniform wall charge accumulation and a uniform discharge voltage in the discharge cells 7.

Figure 2:
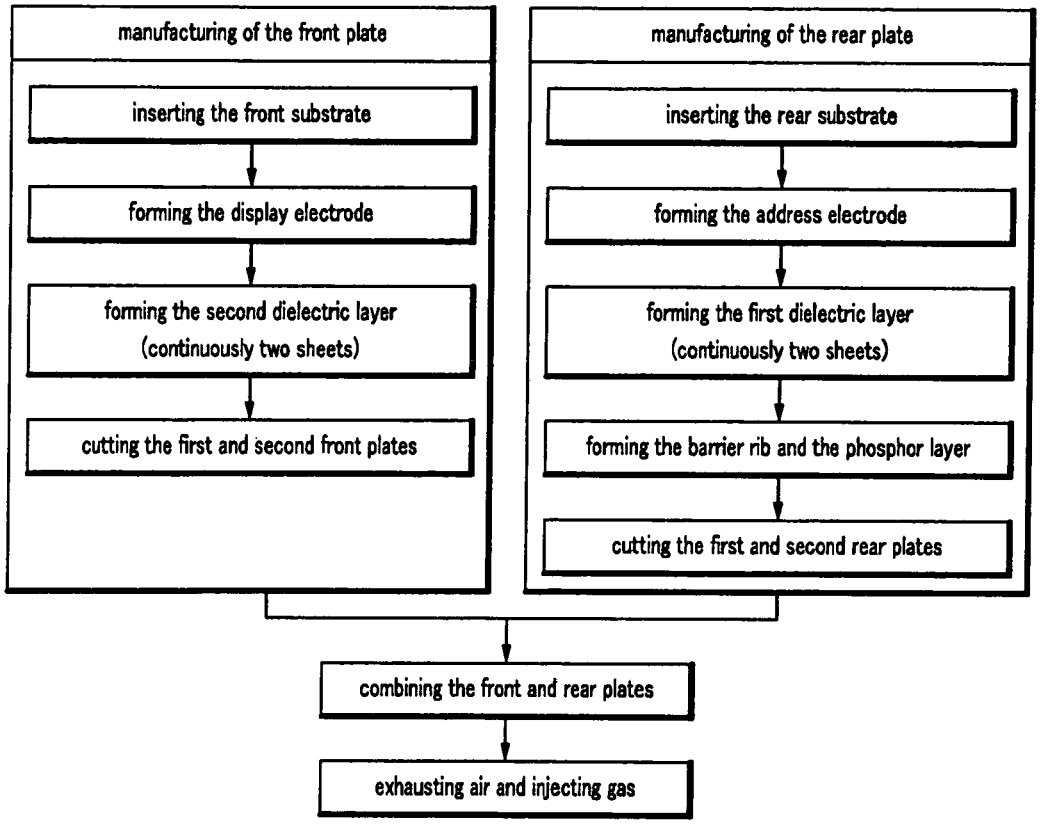
FIG. 2 is a diagram showing a plasma display panel manufacturing process according to an embodiment of the present invention.
Figure 3A:
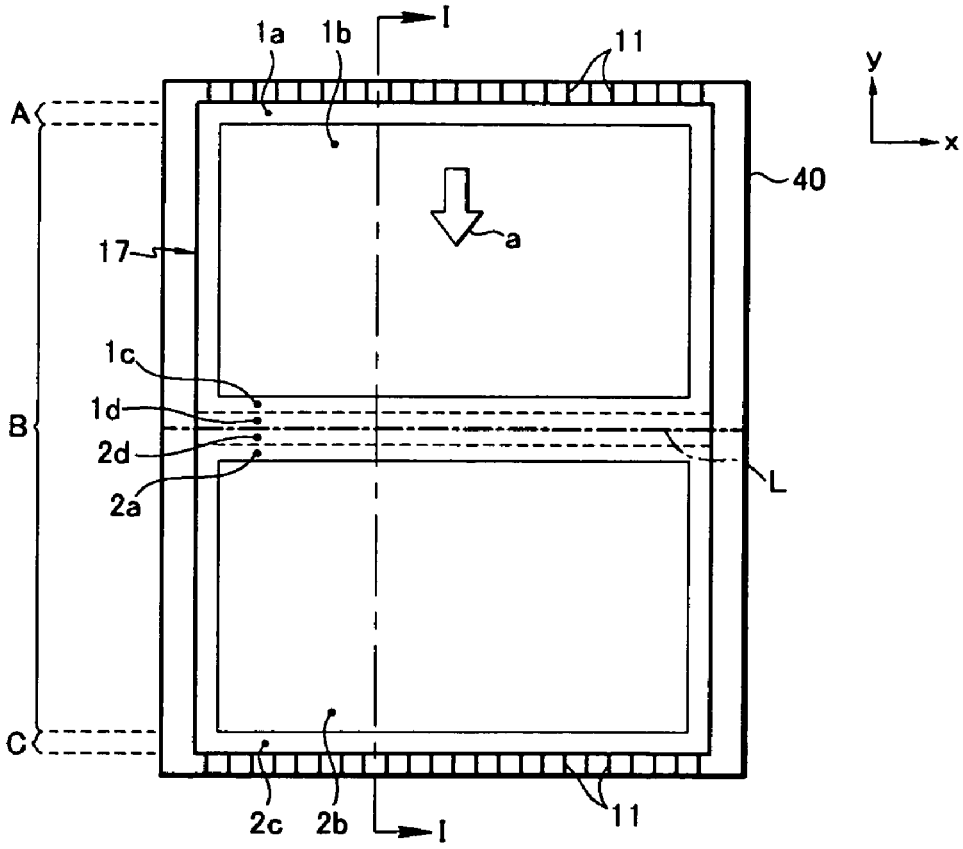
FIG. 3A shows processes for fabricating a rear plate of the plasma display panel according to an embodiment of the present invention.
Figure 3B:
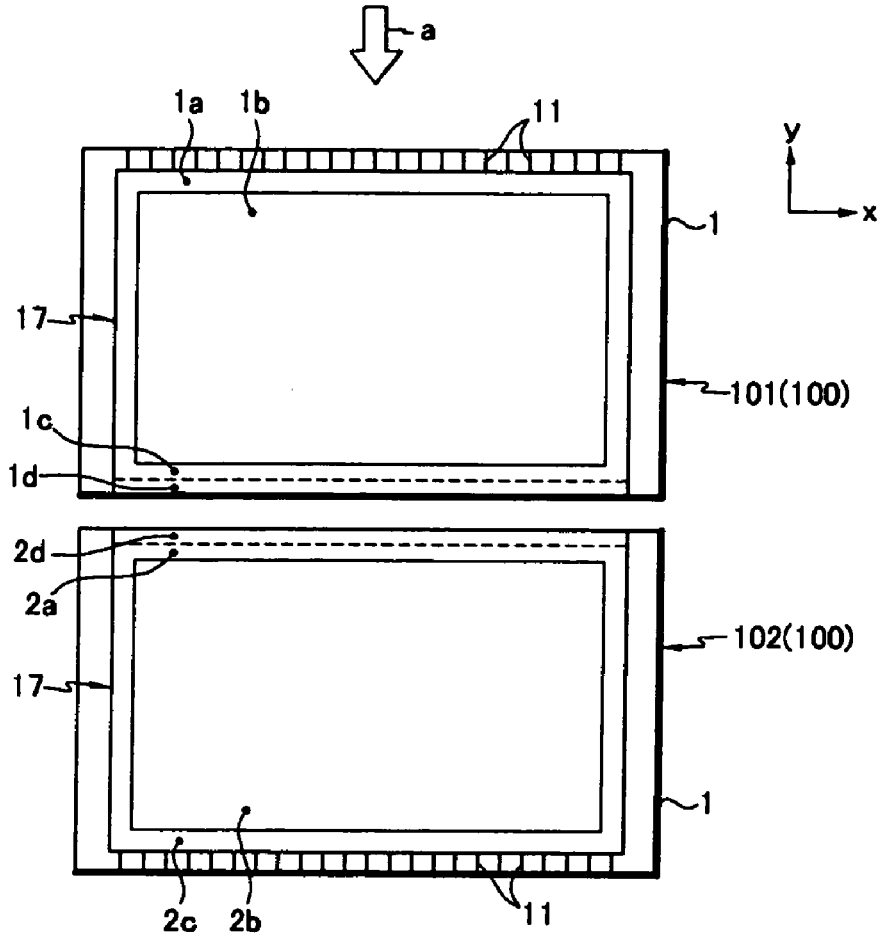
FIG. 3B shows processes for fabricating a rear plate of the plasma display panel according to an embodiment of the present invention.
Figure 3C:
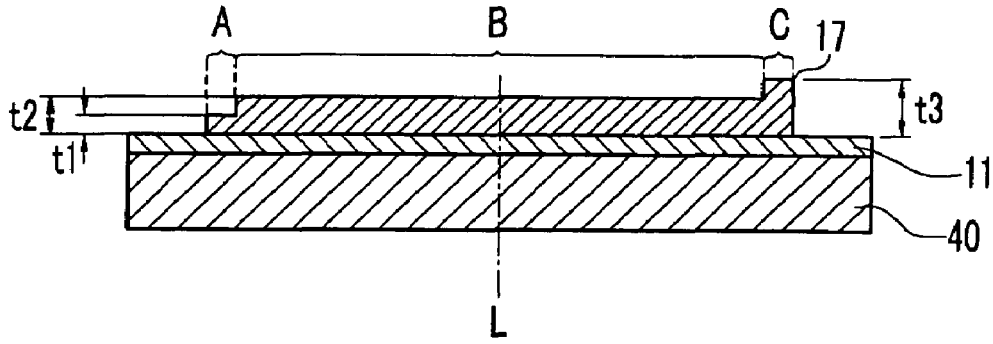
FIG. 3C is a simplified cross-sectional schematic view of the rear plate of the plasma display panel of FIG. 3A, taken at line I-I.
Figure 4A:
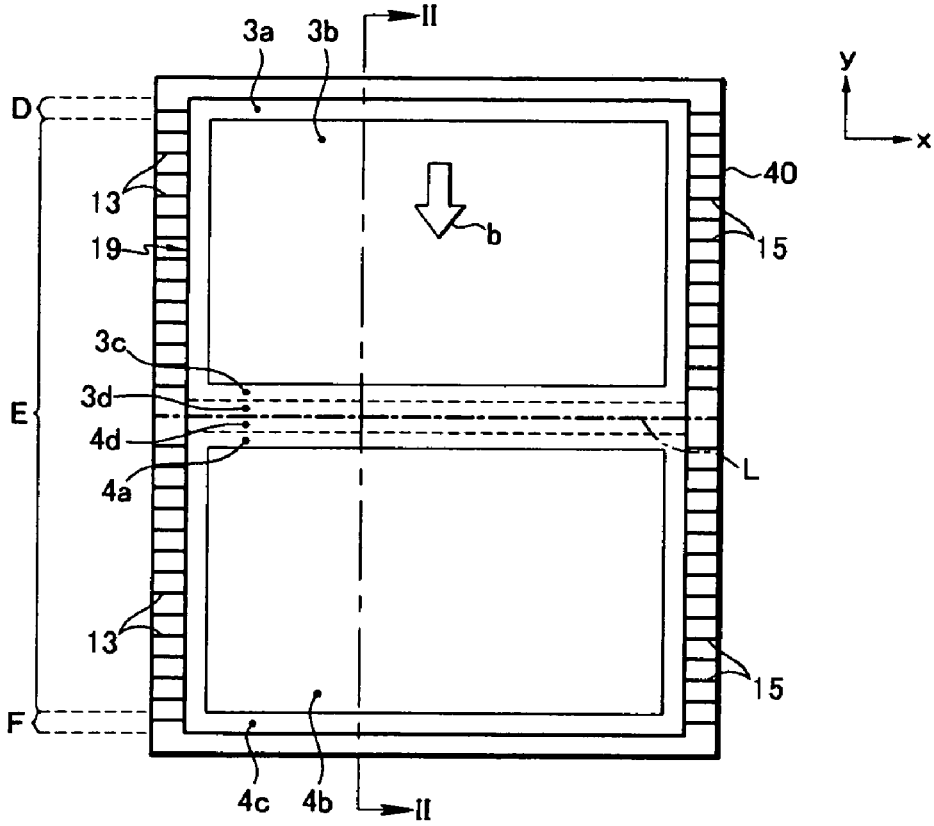
FIG. 4A shows processes for fabricating a front plate of the plasma display panel according to an embodiment of the present invention.
Figure 4B:
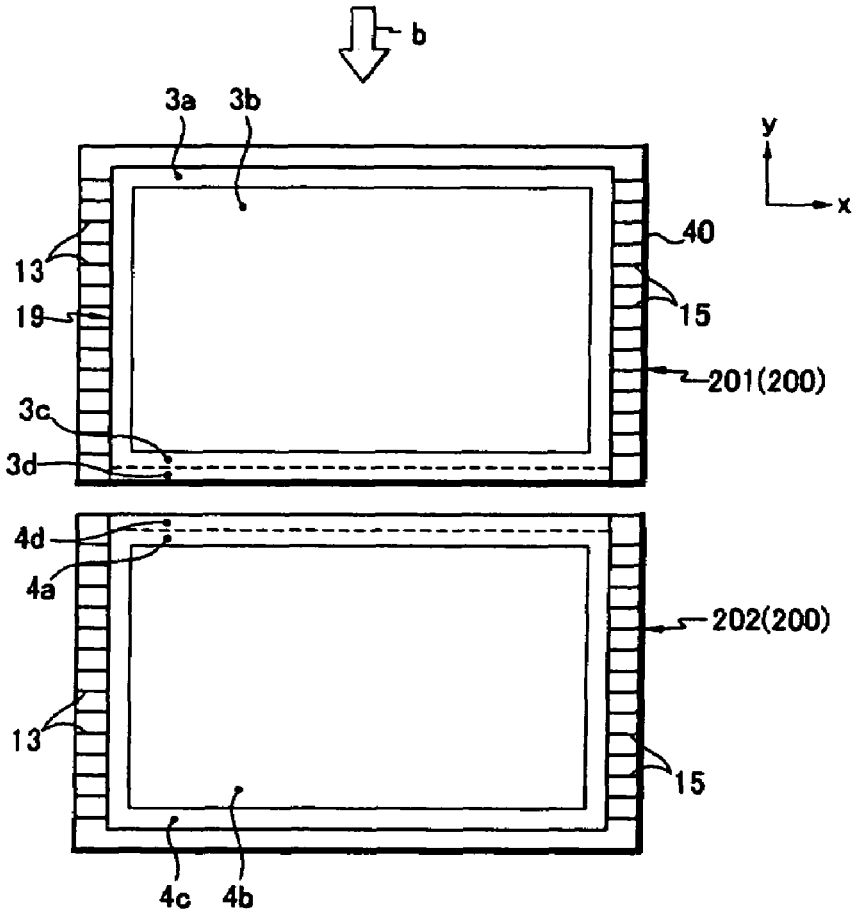
FIG. 4B shows processes for fabricating a front plate of the plasma display panel according to an embodiment of the present invention.

The embodiments provide a manufacturing method capable of uniformly forming the dielectric layer. This method will be explained in greater detail referring to FIGS. 2 to 4B. FIG. 2 is a diagram showing a plasma display panel manufacturing process according to an embodiment of the present invention, FIGS. 3A and 3B show processes for fabricating a rear plate of the plasma display panel according to one embodiment of the present invention, and FIGS. 4A and 4B show processes for fabricating a front plate of the plasma display panel according to an embodiment of the present invention.

Referring to the drawings, in a PDP manufacturing method according to the exemplary embodiments, the rear plate 100 and the front plate 200 are formed in separate processes, and the rear and front plates 100 and 200 are then combined together. Subsequently, air is evacuated from the discharge cells 7, formed between the two plates 100 and 200, and a discharge gas is injected into the discharge cells 7. Subsequently, the discharge cells 7 are sealed, thereby completing manufacture of the PDP. Related manufacturing processes excepting the process for fabricating the rear plate 100 and the front plate 200 in the manufacturing method according to the embodiments of the present invention discussed herein can be done as is generally known in the art, so further detailed explanations for these related processes will be omitted for sake of clarity.

The process of fabricating the rear plate 100 may be performed as follows. First, the rear substrate 1 is inserted, then the address electrodes 11 are formed on the rear substrate 1, the first dielectric layer 17 is formed on the address electrodes 11 to cover the address electrodes 11, and the barrier ribs 5 and the phosphor layer 9 are consecutively formed on the first dielectric layer 17.

The process of fabricating the front plate 200 may be performed as follows. The front substrate 3 is inserted, the display electrodes 13 and 15 are formed on the front substrate 3, and the second dielectric layer 17 and the protective layer 19 are consecutively formed on the display electrodes 13 and 15.

In the exemplary embodiments, one rear plate can be fabricated from one mother glass. It is also possible that a plurality of rear plates are fabricated from one mother glass.

When a plurality of rear plates are fabricated from one mother glass, the processes for forming the address electrodes 11, the first dielectric layer 17, the barrier ribs 5 and the phosphor layer 9 may be separately performed depending on a number of rear plates to be created. The process for fabricating a rear plate further includes cutting one mother glass into a plurality of rear plates. That is, referring to FIG. 3A, a mother glass 40 is cut along a cutting line L so that a plurality of rear plates, e.g., the first and second rear plates 101 and 102 (illustrated in FIG. 3B) are obtained.

Similarly, one front plate can be fabricated from one mother glass, and it is also possible that a plurality of front plates are fabricated from one mother glass.

When a plurality of front plates are fabricated from one mother glass, the processes for forming the display electrodes 13 and 15, the second dielectric layer 19, and the protective layer 21 may be separately performed depending on a number of front plates to be created. The process for fabricating a front plate further includes cutting one mother glass into a plurality of front plates. That is, referring to FIG. 4A, a mother glass 40 is cut along a cutting line L so that a plurality of front plates, e.g., the first and second front plates 201 and 202 (illustrated in FIG. 4B) are obtained.

The processes for forming the address electrodes 11, the barrier ribs 5 and the phosphor layer 9 can be performed as is known in the art, and the processes for forming the display electrodes 13 and 15 and the protective layer 21 can be performed as is known in the art, so further detailed explanations for these processes will be omitted for sake of clarity.

FIGS. 3A and 3B illustrates an example embodiment in which two rear plates, i.e., the first and second rear plates 101 and 102, are fabricated from one mother glass 40, and FIGS. 4A and 4B illustrate an example embodiment in which two front plates, i.e., the first and second front plates 201 and 202, are fabricated from one mother glass 40. However, as is easily understood by a person skilled in the art, the present invention may also be applied to a method for fabricating more than two plates from one mother glass.

In the manufacturing method according to the example embodiment, the first dielectric layer 17 is formed over the address electrodes 11 in the direction of the length of the address electrodes 11, covering the address electrodes and the surface of the rear substrate up to at least one of the opposing edges of the rear substrate 1 that are disposed along the length of the rear substrate running the same direction as the address electrodes 11.

To form the dielectric layer 17, a dielectric material paste is continuously applied using a coating device (not shown) in a direction 'a' (i.e., the y-axis direction in the drawing) of the arrow in FIGS. 3A and 3B. As mentioned above, the mother glass 40 may have a size corresponding to one or more rear substrates.

During the coating, a thickness of the first dielectric layer 17 may be varied depending on a viscosity of the dielectric material paste, friction between the dielectric material paste and an inner surface of a nozzle of the coating device, spraying time, and similar phenomena.

Each rear substrate may include a display area 1*b* (or 2*b*) and a non-display area 1*a* and 1*c* (or 2*a* and 2*c*) surrounding the display area. The first dielectric layer 17 may be formed with a first thickness t1 on a portion of the non-display area 1*a* positioned near one edge of the first substrate The first dielectric may be formed with a second thickness t2, which is different from the first thickness t1, on a remaining portion of the first substrate. Referring to FIGS. 3A and 3B, the dielectric material paste is continuously applied from the non-display area 1*a* positioned near one edge of the rear plate 101, i.e., one edge of the mother glass 40, to the non-display area 2*c* of the neighboring rear plate 102, passing through the display area 1*b*, the non-display area 1*c*, and an outside area 1*d* of the first rear plate 101, and through an outside area 2*d*, a non-display area 2*a*, a display area 2*b*, and a non-display area 2*c* of the second rear plate 102.

In particular, the first dielectric layer 17 is formed with a first thickness t1 on a portion (shown as region A) on the non-display area 1*a* and with the second thickness t2 on a remaining portion of the substrate (shown as region B), i.e., a portion on the display area 1*b*, the non-display area 1*c*, the outside area 1*d*, the outside area 2*d*, the non-display area 2*a*, the display area 2*b*, and the non-display area 2*c*. During this process, the second thickness t2 may be greater than the first thickness t1, as depicted in FIG. 3C. Further, the second thickness t2 may be uniform over the whole remaining portion of the substrate.

The dielectric material paste is continuously applied up to a portion on the non-display area 2*c* disposed near the edge of the second rear plate 102. At this point, the first dielectric layer 17 may be formed with a third thickness t3 on a portion (shown as region C) of the non-display area 2*c*. The third thickness t3 may be greater than the second thickness t2, as further illustrated in FIG. 3C.

In the case that two sheets of first and second rear plates 101 and 102 are formed using one mother glass 40, referring to FIG. 3B, the step for manufacturing the rear plate 100 includes a step for cutting the mother glass 1 in the region of the first dielectric layer 17 having the second thickness t2.

The first dielectric layer 17 is formed with the first thickness t1 at an early stage of applying the dielectric material, then the second thickness t2 while the dielectric material is continuously applied, and the third thickness t3 at a final stage of applying the dielectric material.

In the case where one rear substrate is fabricated from one mother glass or more than two rear substrates are fabricated from one mother glass, the first dielectric layer 17 may also be formed with three thicknesses t1, t2, and t3.

In the manufacturing method according to the exemplary embodiments, in the case that two rear plates are formed from one mother glass, the first dielectric layer 17 of each of the formed rear plates is formed starting with a portion near one edge of the rear plate continuing up to the opposite edge of the rear plate. Accordingly, in a portion of the rear substrate where the first dielectric layer 17 is not formed, the address electrodes are exposed to form a terminal.

In the process for manufacturing the front plate 200, the second dielectric layer 19 is formed on the display electrodes 13 and 15 in a similar way to the process for manufacturing the rear plate 100.

Referring to FIGS. 4A and 4B, a process for forming the second dielectric layer 19 on the front substrate 3 will be explained in detail.

The process for forming the second dielectric layer 19 is performed along a direction 'b' (i.e., in the direction that the address electrodes runs, or the y-axis in the drawings) in FIGS. 4A and 4B using a coating device (not shown).

In the process for forming the second dielectric layer 19, a dielectric material is continuously applied on the mother glass 40, starting from a portion near one edge of the front plate 200 continuing up to an opposite edge of the front plate 200.

The mother glass 40 may have a size corresponding to one front substrate, or it may have a size corresponding two front substrates, i.e., first and second front substrates, as shown in FIGS. 4A and 4B.

A thickness of the second dielectric layer 19 may be varied depending on a viscosity of the dielectric material paste, friction between the dielectric material paste and an inner surface of a nozzle of the coating device, spraying time, and similar phenomena.

Each front substrate may include a display area 3*b* (or 4*b*) and a non-display area 3*a* and 3*c* (or 4*a* and 4*c*) surrounding the display area. The second dielectric layer 19 may be formed with a fourth thickness t4 on a portion of the substrate in the non-display area 3*a*, which is positioned near one edge of the second substrate. The remainder of the second dielectric layer may be formed with a fifth thickness t5, which is different from the fourth thickness t4. Referring to FIGS. 4A and 4B, the dielectric material paste is continuously applied starting from the non-display area 3*a*, which is positioned near one edge of the front plate 201, i.e., one edge of the mother glass 40, continuing to the non-display area 4*c* of the neighboring front plate 202, passing through the display area 3*b*, the non-display area 3*c*, and an outside area 3*d* of the first front plate 201, and through an outside area 4*d*, a non-display area 4*a*, a display area 4*b*, and a non-display area 4*c* of the second front plate 202.

Figure 4C:
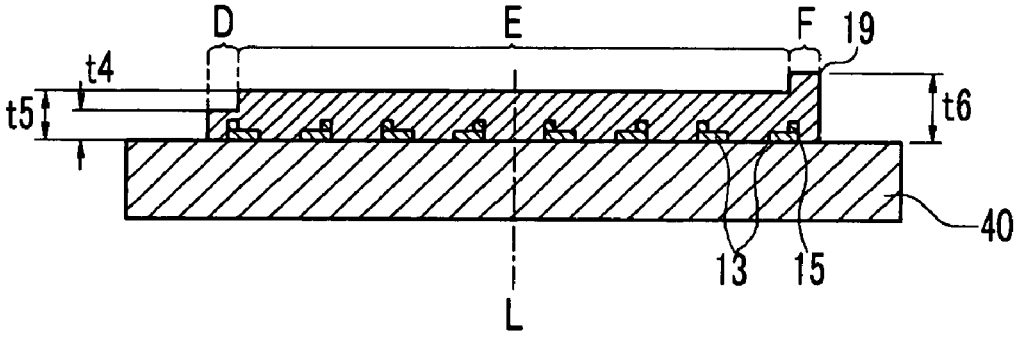
FIG. 4C is a simplified cross-sectional schematic view of the front plate of the plasma display panel of FIG. 4A, taken at line II-II.

The second dielectric layer 19 is formed with the fourth thickness t4 starting in a portion of the substrate (shown as region D) in the non-display area 3*a* and continuing with the fifth thickness t5 in the remaining portion of the substrate (shown as region E), i.e., the display area 3*b*, the non-display area 3*c*, the outside area 3*d*, the outside area 4*d*, the non-display area 4*a*, the display area 4*b*, and the non-display area 4*c*. The fifth thickness t5 may be greater than the fourth thickness t4, as depicted in FIG. 4C. Further, the fifth thickness t5 may be uniform over the whole remaining portion of the substrate.

The dielectric material paste is continuously applied up to a portion of the substrate in the non-display area 4*c* disposed near the edge of the second front plate 202. The second dielectric layer 19 may be formed with a sixth thickness t6 on a portion of the substrate (shown as region F) in the non-display area 4*c*. The sixth thickness t6 may be greater than the fifth thickness t5, as further illustrated in FIG. 4C.

In the case where two sheets of the first and second front plates 201 and 202 are formed using one mother glass 40, referring to FIG. 4B, the process for manufacturing the front plate 200 includes cutting the mother glass 40 in a region of the second dielectric layer 19 having the fifth thickness t5.

The second dielectric layer 19 is formed starting with the fourth thickness t4 at an early stage of applying the dielectric material, then continuing with the fifth thickness t5 and with the sixth thickness t6 at a final stage of applying the dielectric material.

In the case where one front substrate is fabricated from one mother glass or more than two front substrates are fabricated from one mother glass, the second dielectric layer 19 may also be formed with three thicknesses t4, t5, and t6.

Since according to the present invention, the dielectric layer is formed by continuously applying the dielectric material paste along all plates, the dielectric layer having uniform thickness can be formed even when a plurality of front or rear plates are formed from one mother glass.

While the invention has been described in connection with certain exemplary embodiments it is to be understood by those skilled in the art that the invention is not limited to the disclosed embodiments, but, on the contrary, is intended to cover various modifications included within the spirit and scope of the appended claims and equivalents thereof.

What is claimed is:

1. A plasma display panel comprising:

a first substrate and a second substrate facing each other;

a barrier rib between the first and second substrates and forming discharge cells;

an address electrode extending in a first direction on the first substrate corresponding to the discharge cells;

a phosphor layer in each discharge cell;

a display electrode extending in a second direction crossing the address electrode on the second substrate; and a first dielectric layer covering the address electrode, wherein the first dielectric layer is continuous in the first direction of the address electrode, up to at least one of edges of the first substrate;

the first substrate comprises a display area and a non-display area surrounding the display area;

the first dielectric layer is on the first substrate and covers the non-display area positioned near one edge of the first substrate up to an opposite edge of the first substrate;

the first dielectric layer has a first thickness in a portion of the first dielectric layer on the non-display area; which is positioned near the one edge of the first substrate and has a second thickness, which is different from the first thickness, in a remaining portion of the first dielectric layer; and the second thickness is greater than the first thickness.

2. The plasma display panel of claim 1, wherein the second thickness is uniform over the remaining portion.

3. The plasma display panel of claim 1, further comprising a second dielectric layer covering the display electrode, wherein the second dielectric layer is continuous in the first direction of the address electrode, up to at least one of edges of the second substrate.

4. The plasma display panel of claim 3, wherein:

the second substrate includes a display area and a non-display area surrounding the display area; and the second dielectric layer is formed starting from the non-display area positioned near one edge of the second substrate up to an opposite edge of the second substrate.

5. The plasma display panel of claim 4, wherein the second dielectric layer has a first thickness in a first portion of the second dielectric layer on the non-display area positioned near the one edge and has a second thickness, which is different from the first thickness, in a remaining portion of the second dielectric layer.

6. The plasma display panel of claim 5, wherein the second thickness of the second dielectric layer is greater than the first thickness of the second dielectric layer.

7. The plasma display panel of claim 5, wherein the second thickness of the second dielectric layer is uniform over the remaining portion.

8. A plasma display panel comprising:

a first substrate and a second substrate facing each other;

a barrier rib between the first and second substrates and forming discharge cells;

an address electrode extending in a first direction on the first substrate corresponding to the discharge cells;

a phosphor layer in each discharge cell;

a display electrode extending in a second direction crossing the address electrode on the second substrate; and a first dielectric layer covering the address electrode, wherein the first dielectric layer is continuous in the first direction of the address electrode, up to at least one of edges of the first substrate;

the first substrate comprises a display area and a non-display area surrounding the display area;

the first dielectric layer is on the first substrate and covers the non-display area positioned near one edge of the first substrate up to an opposite edge of the first substrate;

the first dielectric layer has a first thickness in a portion of the first dielectric layer on the non-display area, which is positioned near the one edge of the first substrate and has a second thickness, which is different from the first thickness, in a remaining portion of the first dielectric layer; and the second thickness is smaller than the first thickness and uniform over the remaining portion.

* * * * *

UNITED STATES PATENT AND TRADEMARK OFFICE

CERTIFICATE OF CORRECTION

PATENT NO. : 7,518,311 B2
APPLICATION NO. : 11/181137
DATED : April 14, 2009
INVENTOR(S) : Chong-Gi Hong et al.

It is certified that error appears in the above-identified patent and that said Letters Patent is hereby corrected as shown below:

In the Claims

Column 8, Claim 1, line 65 — After "area" delete ";"
Insert -- , --

Signed and Sealed this
Eleventh Day of January, 2011

David J. Kappos

David J. Kappos
*Director of the United States Patent and Trademark Office*